United States Patent [19]

Kinberg

[11] Patent Number: 4,507,099

[45] Date of Patent: Mar. 26, 1985

[54] TOY EYE CONSTRUCTION

[76] Inventor: Benjamin Kinberg, 200 Fifth Ave., New York, N.Y. 10010

[21] Appl. No.: 519,066

[22] Filed: Aug. 1, 1983

[51] Int. Cl.[3] ..... A63H 3/38

[52] U.S. Cl. ..... 446/389; 446/267

[58] Field of Search ..... 446/267, 389, 392, 343, 446/344, 27

[56] References Cited

U.S. PATENT DOCUMENTS

| | | | |
|---|---|---|---|
| 1,981,333 | 11/1934 | Schavior | 46/165 UX |
| 2,685,760 | 8/1954 | Wagner | 46/165 |
| 3,841,019 | 10/1974 | Lorenzo | 46/145 R X |

*Primary Examiner*—Mickey Yu

*Attorney, Agent, or Firm*—Arthur T. Fattibene

[57] ABSTRACT

A toy having an eye construction which is formed as a sealed container having a supply of a fluid medium confined within the container and having a plurality of particles suspended or dispersed throughout the fluid medium so that said particles move in the fluid medium as the toy is shaken or moved by the child to lend a pleasing effect to the toy. The container is provided with simulated eye protrusions arranged to align with the eye opening in a toy's head, and the container is secured within the toy's head adjacent to the eye opening therein.

3 Claims, 6 Drawing Figures

TOY EYE CONSTRUCTION

FIELD OF INVENTION

This invention is directed to a child's animated toy and more specifically to a novel eye construction for use in such toys.

PRIOR ART

Heretofore, various types of children's toy dolls and/or animated plush type toys are known to simulate human and/or animal characteristics. In such toys, various efforts have been made to simulate the eyes of such toys. Generally, such eye constructions were made of glass to simulate a real eye. Often, such eyes comprised simply of a button. In other known constructions, the eyes were painted on the face or head of the doll. Also, mechanical eyes are known whereby they are made to open and close. All of the known eye construction have in one form or another enhanced the appeal and/or play value of such toys.

OBJECTS

An object of this invention is to provide an improved eye construction for use in children's toys which will impart to such toys an appeal and play value which is not achieved by the known eye constructions.

Another object is to provide an eye construction for use in animated dolls and toys which is relatively simply to make and which is positive in operation.

Another object is to provide an eye construction which is safe for small children, and which is rendered virtually indestructable by relatively small children.

Another object is to provide an eye construction which will impart an appeal to the toy which is novel and which is distinctive over the known eye constructions.

Another object is to provide an eye construction which is universally adapted for use with all types of animated toys and dolls.

BRIEF SUMMARY OF THE INVENTION

The foregoing objects and other features of the invention are attained by an eye construction which is adapted for use in all types of dolls and/or animated toys. Essentially, the eye construction comprises a container which is generally flat in configuration and having simulated eye portions which are adapted to be disposed within the head of the toy adjacent the eye openings therein. The container is filled with a fluid medium generally of a clear liquid, and which liquid is sealed within the container. Dispensed within the liquid are a plurality of particles that will float and/or be dispersed throughout the liquid as the toy is moved or shaken by the child. The particles may comprise a plurality of like or varied colored sparklers.

FEATURES

A feature of this invention resides in the provision of a sealed container having sealed therein a fluid medium in which various particles are dispersed therein.

Another feature resides in a container having simulated eye portions forming windows for viewing the particles floating in the liquid as the toy is moved or shaken.

Another feature resides in the provision wherein the eye construction is internally fixed in the head of the toy so as to be safe for child's play.

Another feature resides in the provision wherein the floating particles enhance the play value and appeal of the toy.

Other features and advantages will become readily apparent when considered in view of the specifications in which:

DETAILED DESCRIPTION

Figure 1:
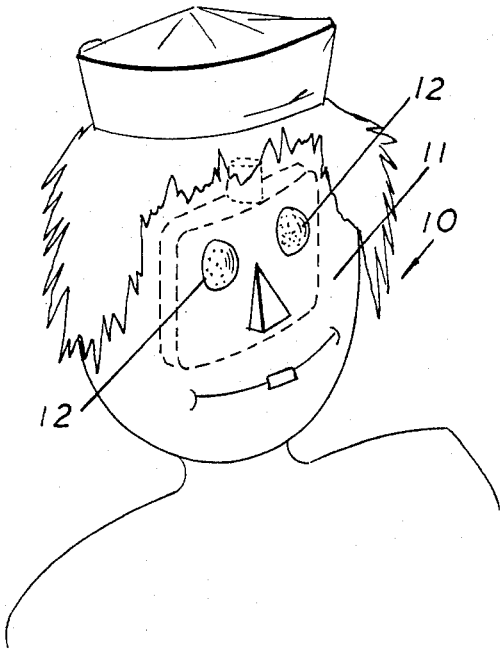
FIG. 1 is a perspective view of a doll's head embodying the invention.

In the drawings, there is shown in FIG. 1 a child's doll or toy 10 embodying the invention. It will be understood that the toy 10 may take many forms of either human or animal characteristics, and that the present invention is not limited to any doll's form or shape. The illustrated toy 10 comprises a doll, e.g. a stuffed or molded doll's figure having a head portion 11 which is provided with eye openings 12. In accordance with this invention, a novel eye construction 13 is provided to simulate the eye portion of the toy 10.

Figure 2:
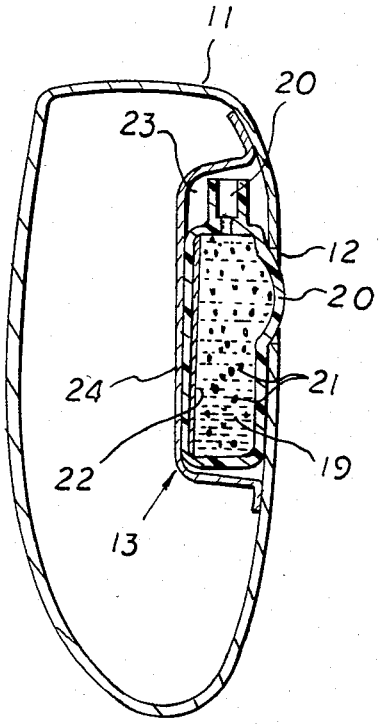
FIG. 2 is a detail side section view of the doll's head of FIG. 1.
Figure 4:
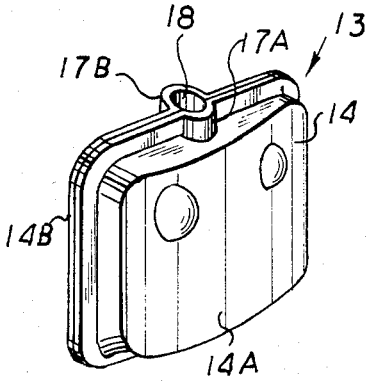
FIG. 4 is the eye construction assembly.
Figure 3:
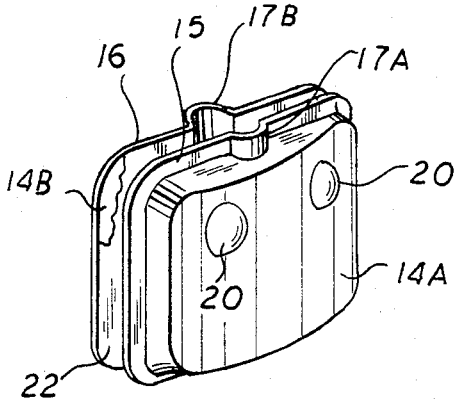
FIG. 3 is a perspective view of the eye construction during the construction thereof.

Referring to FIGS. 2, 3 and 4, the eye construction 13 comprises a container 14 which in the illustrated embodiment is defined by a pair of complementary sections 14A and 14B. Section 14A defines a front surface portion and 14B the back surface of the container. Preferably the container may be formed of a suitable ridge plastic material that is resistant to breaking and/or cracking for safety purposes. It will be understood that the respective sections 14A and 14B can be either vacuum formed or injection molded for ease of manufacture. The respective sections 14A and 14B may be provided with complementary flat circumscribing flange portions 15 and 16 whereby the sections can be mated together and sealed or otherwise secured to form a fluid tight container as seen in FIG. 4. If the sections are formed of a thermoplastic material, the sections can be effectively heat sealed. Also, suitable bonding adhesives may be used to seal the sections together.

The respective sections 14A, 14B are also formed with a short neck portion 17A, 17B which in the sealed or assembled position define an inlet opening 18.

A supply of a fluid material 19, e.g. a clear liquid which may comprise water, a mineral oil or a combination thereof is disposed in the container 13. The fluid or liquid 19 is sealed within the container 11 by a stopper 20 or other suitable closure. Preferably, the stopper 20 is heat sealed so as to insure that a small child cannot remove it.

Disposed within the liquid or fluid 19 are a plurality of particles 21 which are suspended and/or which will float at random within the liquid when the toy is handled or shaken. The particles 21 may comprise various like or variable colored sparklers which may be formed of foil material or other like material which will be compatible with the fluid or liquid 19.

It will be understood that the liquid will have a specific gravity that will permit the particles to float therein and/or will slowly settle as the toy is shaken or moved by the child.

As best seen in FIG. 2, the front surface 14A of the container is formed with an arcuate surface so as to conform to the curvature of the doll's head 11. Also, the front surface 14A may be provided with a protruding eye portion 20 which defines the window through which the child may view the particles 21 as they float within the liquid medium 19. To provide for further contrast, the back surface portion 14B may be provided with a layer of a colored pigment 22 which may either be painted on the back portion 14B or it may comprise a decal type layer which may be adhesively secured to one side of the back section 14B. Preferably, the back section may be painted or provided with a white colored backing 22.

In the assembled position as shown in FIGS. 1 and 2, the protruding eye portions 20 are disposed in alignment with the eye opening 12 formed in the toy's head 11. It will also be understood that the container may be suitably secured in place within the toy's head by various means. In the illustrated embodiment, the container 14 having the eye simulation is disposed in a pocket 23 which is formed by a layer of material 24 which is suitably secured to the toy's head 11. Also, the container 14 may be adhesively secured to the inside surface of the toy's head; and/or fastened interiorly of the doll's head 11 by any suitable means.

In the described arrangement, it will be apparent that a totally distinctive appeal is imparted by the eye construction. Variations of the appeal can be imparted to the toy by adding color to the fluid or liquid 19 and/or to the particles suspended therein.

Figure 5:
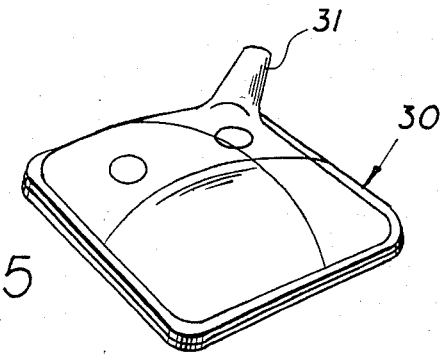
FIG. 5 is a modified construction.

FIG. 5 illustrates a modified embodiment. In this form, the container 30 is formed in a manner similar as herein described, and it differs in that the opening or neck 31 is located at a corner portion of the container.

Figure 6:
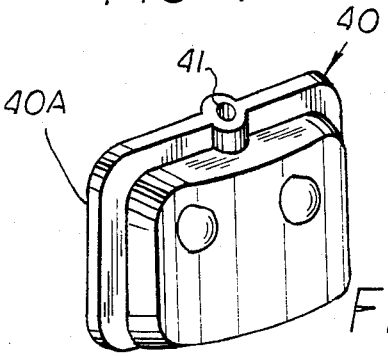
FIG. 6 is another modified construction.

FIG. 6 illustrates another embodiment which may be preferred in the eye construction herein described. In this form of the invention the container 40 is blow molded as an integral unit in a generally flat configuration or other suitable shape to fit the shape or head of the toy in which the eye construction is to be incorporated. The container 40 is preferrably formed of a clear or transparent material. The opening 41 to the container 40 is sealed with a suitable stopper as herein before described, so as to confine the liquid medium within the container 40. Dispersed within the liquid medium are the particles or sparklers as herein before described. In this form of the invention its exterior of the back side 40A of the container may be coated with a pigment or layer of opaque material, or other suitable contrasting material, so as to accentuate the simulated eyes in the finished toy.

The eye construction herein described are particularly suitable in stuffed or plush type dolls or animated toys. The eye constructions described can also be used with convention type dolls that are not considered as stuffed or plush toys.

From the foregoing, it will be apparent that the improved eye construction is rendered universally adapted to all types of dolls and/or animated toys, and that the eye construction can be readily made simply and inexpensively, and that it imparts to the toy a novel and pleasing appearance which is amusing to small children.

While the invention has been described with respect to a particular embodiment thereof, it will be readily appreciated and understood that variations and modifications can be made without departing from the spirit or scope of the invention.

What is claimed is:

1. An improved animated toy having human or animal characteristics having a head portion formed with eye simulated openings, the improvement of an eye construction for use in the head portion, said eye construction comprising a sealed container having a front surface portion contoured to conform to the inner curvature of the head portion, said front surface having a protrusion for simulating an eye curvature, said protrusion being disposed within the eye opening, and said front surface portion being formed of a clear, see-through material, a fluid medium occupying substantially the entire volume of said container, said fluid medium being sealed within said container, a plurality of small, colored, sparkler type particles dispersed throughout said fluid medium, and said fluid medium having a viscosity sufficient to maintain said particles randomly suspend ed within said fluid medium as the toy is shaken and moved.

2. The invention as defined in claim 1, and means securing said sealed container in position within the head portion of the toy for maintaining it in position relative to the eye openings.

3. An eye construction for use in the head portion of a child's animated toy having a head portion formed with an eye opening comprising a sealed container, a protruding portion simulating the curvature of an eye formed on a surface portion of said container, said protruding portion being sized to accommodate the eye opening formed in the head portion of an animated toy, a fluid medium occupying substantially the entire volume of said container sealed within said container and a plurality of small, colored, sparkler type particles dispersed throughout said fluid medium, said fluid medium having a viscosity that permits said particles to randomly float within the fluid medium upon any movement of the toy.

* * * * *